US005658226A

United States Patent [19]

Mentz

[11] Patent Number: 5,658,226

[45] Date of Patent: Aug. 19, 1997

[54] JOGGING APPARATUS

[76] Inventor: Cynthia P. Mentz, 306 Hawthorne Dr., Wilmington, Del. 19802

[21] Appl. No.: 522,817

[22] Filed: Aug. 28, 1995

[51] Int. Cl.[6] ..... A63B 5/08

[52] U.S. Cl. ..... 482/74; 472/126

[58] Field of Search ..... 482/15, 26, 27, 482/28, 29, 30, 14, 52, 74, 51, 148; 472/126

[56] References Cited

U.S. PATENT DOCUMENTS

| | | | |
|---|---|---|---|
| 3,641,601 | 2/1972 | Sieg | 5/345 |
| 3,850,427 | 11/1974 | Schwab | 472/126 |
| 4,146,222 | 3/1979 | Hribar | 5/345 |
| 4,253,661 | 3/1981 | Russell | 272/96 |
| 4,548,405 | 10/1985 | Lee et al. | 482/26 |
| 4,901,997 | 2/1990 | Varga | 472/126 |
| 5,277,675 | 1/1994 | Shifferew | 482/74 |

*Primary Examiner*—Stephen R. Crow
*Attorney, Agent, or Firm*—Breneman, Georges & Krikelis

[57] ABSTRACT

A jogging apparatus comprising a base and a hollow container mounted on the base with a plurality of shock absorbers. The container having an open top defined by a rim, at least one side wall terminating at the rim, an interior space and a bottom, the interior space filled with a predetermined amount of sand.

13 Claims, 3 Drawing Sheets

JOGGING APPARATUS

BACKGROUND OF THE INVENTION

1. Field of the Invention.

This invention relates generally to exercise devices and more particularly to a jogging apparatus.

2. Description of the Related Art.

In recent years, the general public has become quite concerned with its health, and rightfully so. Due to the increase in pollution as well as recent awareness regarding the effect of cholesterol and fat on the heart, aerobic exercise has almost become a necessary form of assistance in combatting these problems. Some common forms of aerobic exercise include running, jogging, walking, swimming and general aerobic exercising. Aerobic exercising keeps the heart and lungs strong, and with a proper diet, may reduce the risk of a heart attack or a stroke, among other things.

Regarding some of these forms of aerobic exercise, and more particularly running or jogging, it is common for exercisers to merely go outdoors and jog or run for a predetermined distance. However, this form of exercise is only possible during the warmer months of the year. In addition, it may be difficult for one living in a city environment to find an area in which to comfortably run or jog over long distances. Accordingly, local health centers formed indoor running tracks to solve this problem. However, most health centers incorporate several types of exercise equipment in addition to an indoor track, and thus often cost a significant amount of money to use.

Therefore, for one to be able to exercise year round without the costs of joining a health club, several entities have designed running machines. These machines are premised upon two basic designs. The first is the moving tread mill type which actually gives the user the sensation of forward movement. The other is the "in place" jogging type apparatus. Regarding the "in place" type jogging apparatus, designers have incorporated a resilient yielding surface which simulates a soft running surface such as that of a common running track. A resilient yielding surface forces the user to engage in greater up and down movement during the use of the device. Such up and down movement of the center of gravity of the body results in greater energy expended during exercising. This, in turn, results in greater aerobic output within a shorter period of time.

An example of an "in place" type jogging apparatus incorporating a resilient yielding surface structure can be seen in U.S. Pat. No. 4,146,222. The '222 device discloses an "in place" jogging apparatus including a pair of separate, flexible and deformable fluid filled volumes which are confined in an enclosure and react reciprocally to each other as body weight is applied alternately to each volume.

However, due to production and design costs, such an "in place" type jogger may be quite expensive. In addition, the yielding of the surface may not be a natural one which could, for example, cause back problems in the user. Further, depending on the size and weight of the user, a device like that of the '222 patent could be susceptible to damage (i.e. bursting of the volumes). Finally, an "in place" type jogger is subject to natural wear and tear from long term use.

It is thus a primary object of the present invention to alleviate some of the aforementioned problems and provide a naturally resilient or yielding surface, jogging apparatus.

It is another object of the present invention to provide an inexpensive resilient yielding surface jogging apparatus.

It is an additional object of the present invention to provide an "in place" jogging apparatus which will not be susceptible to natural wear and tear due to long term use.

It is a further object of the present invention to provide an "in place" jogging apparatus which provides for greater aerobic expenditure within a shorter period of time.

It is an even further object of the present invention to provide a resilient yielding surface jogging apparatus which incorporates the use of natural sand as the resilient yielding surface.

It is an additional object of the present invention to provide a year round jogging apparatus which can be used in an indoor or outdoor environment.

These and other objects of the present invention will be clear from the following description.

SUMMARY OF THE INVENTION

The present invention is a jogging apparatus which provides a natural resilient yielding surface for indoor or outdoor use.

The present jogging apparatus comprises a base with a hollow container mounted on the base. The container is mounted on the base with a plurality of shock absorbers, and includes an open top defined by a rim, at least one side wall terminating at the rim, and a bottom. The container is filled with a predetermined amount of sand.

BRIEF DESCRIPTION OF THE DRAWINGS

The invention can be more fully understood from the following description thereof in connection with the accompanying drawings described as follows.

DESCRIPTION OF THE PREFERRED EMBODIMENT(S)

Figure 1:
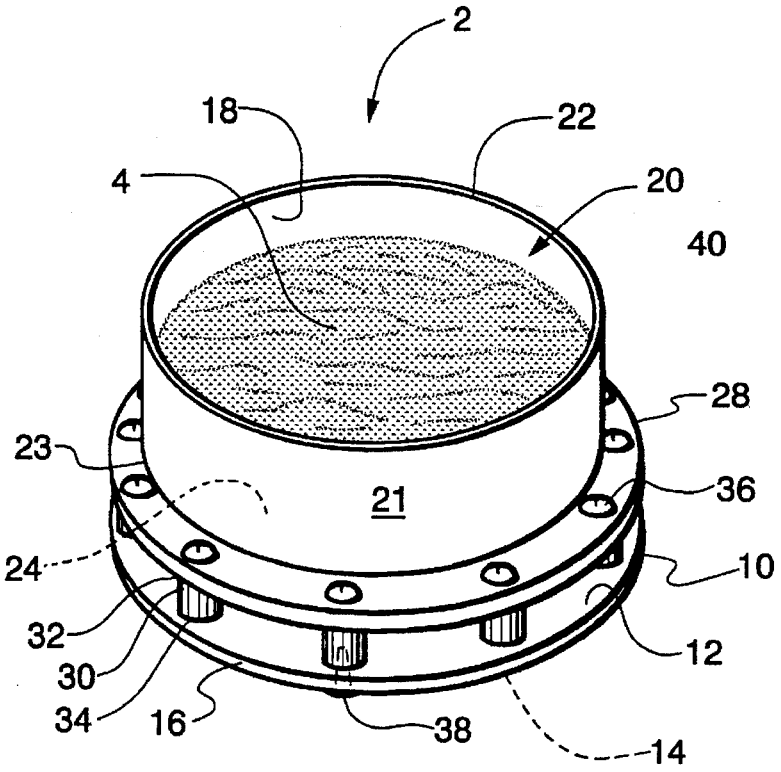
FIG. 1 is a schematic perspective of one embodiment of the jogging apparatus of the present invention.

Throughout the following detailed description, similar reference characters refer to similar elements in all figures of the drawings.

FIG. 1 shows a perspective view of a jogging apparatus 2 of the present invention. The apparatus 2 is comprised of a base 10, an open container 20 and a plurality of shock absorbers 30. The container 20 is filled with sand 4.

Figure 3:
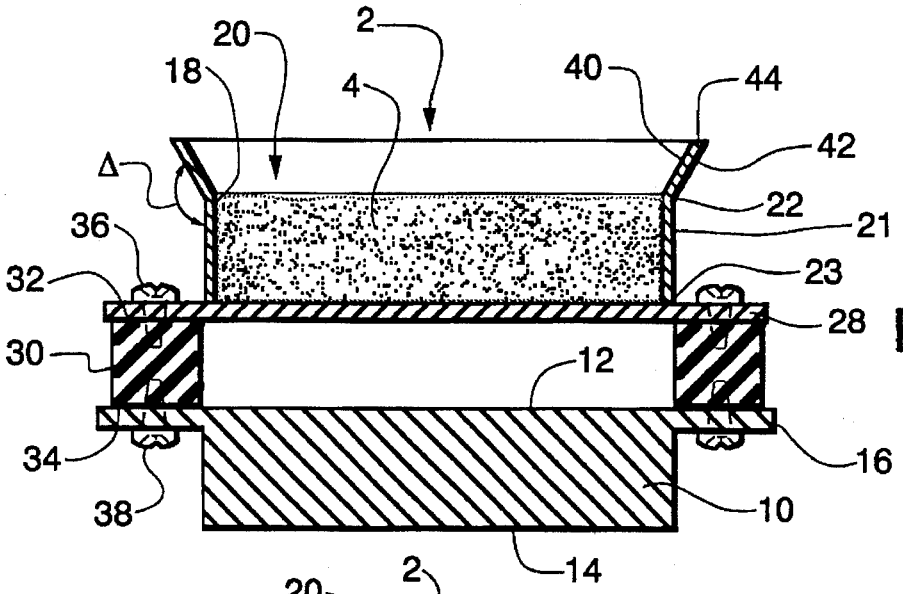
FIG. 3 is a cross-sectional view of the embodiment shown in FIG. 2 of the jogging apparatus of the present invention.

Referring now to FIGS. 1 and 3, the base 10 includes a top 12, a bottom 14 and a flange 16. The base 10 may be a solid plate, preferably circular, or it may include an opening to form a ring like shape. As best seen in FIG. 3, the flange 16 of the base 10 extends outwardly from the top 12 of the base 10 in a direction parallel to the ground surface. The flange 16 need only extend outwardly to a distance equal to or greater than the diameter of one of the plurality of shock absorbers 30 as will be discussed in the forthcoming paragraphs.

The container 20 is preferably cylindrical in shape, defining an interior space 18, and includes a bottom 24. The interior space 18 of the container 20 is where the sand 4 is held. The container 20 further includes a side wall 21 which itself has a top 22 and a bottom 23. In the preferred embodiment of the present invention, the container 20 is cylindrical. The bottom 24 extends beyond the side Wall 21 to form a circular flange 28. The flange 28 extends outwardly from the side wall 21 perpendicular to the side wall. The flange 28 is preferably coextensive and parallel with the flange 16 of the base 10.

The description of the container as cylindrical is preferred, however, in other embodiments, the side wall 21 may comprise several straight side walls connected to each other to form a plurality of side walls 21 of the container 20. An example of this, not illustrated, would be four side walls 21 attached to each other at right angles forming a square. Accordingly, in this second embodiment, the flange 28 of the container 20 would preferably also be square in shape.

In the preferred embodiment, the side wall 21 extends from the bottom 23 to the top 22 a distance ranging from three to six inches in length.

The present jogging apparatus also incorporates a plurality of shock absorbers 30. The shock absorbers 30 have a top 32 and a bottom 34. The top 32 of each of the shock absorbers 30 is fixedly attached to the flange 28 of the container 20. Conversely, the bottom 34 of each of the shock absorbers 30 is fixedly attached to the flange 16 of the base 10. The diameter of each of the shock absorbers 30 should preferably be equal to or slightly less than the distance that the flange 28 extends out from the side wall 21 of the container 20.

The shock absorbers 30 are attached to the base 10 and the container 20 as follows. The top 32 of each shock absorber 30 is attached to the flange 28 of the container 20 through the use of a first screw 36. On the other hand, the bottom 38 of each shock absorber 30 can be attached to the flange 16 of the base 10 through the use of a second screw 38. Although this is the preferred mode of attachment, other modes of attachment, such as glue, fasteners or cement, will work just as well.

In the preferred embodiment each of the shock absorbers 30 is comprised of a rubber stud bumper having a hardness of 45–55 shore A, and is approximately one and one quarter inch in diameter by one and one quarter inch in thickness. However, various other shock absorbing devices may be used, for example coil springs, leaf springs and the like. The base 10 and container 20 are preferably fabricated of a solid material which can withstand a significant amount of weight and pressure (i.e. at least the combined weight and pressure of one person jogging in sand within the container along with the sand itself), such as iron, sheet metal, plastic, wood, or any composite thereof, among other things. It is important to keep in mind that it is the flange 28 of the container 20 and the flange 16 of the base 10 which must be able to withstand the majority of the weight and pressures applied by the user, therefore the flange may be reinforced with, for example, ribs or the like.

The sand 4 is preferably 40 mesh play sand which is screened, washed and dried. However, any silica sand will also be acceptable.

Figure 2:
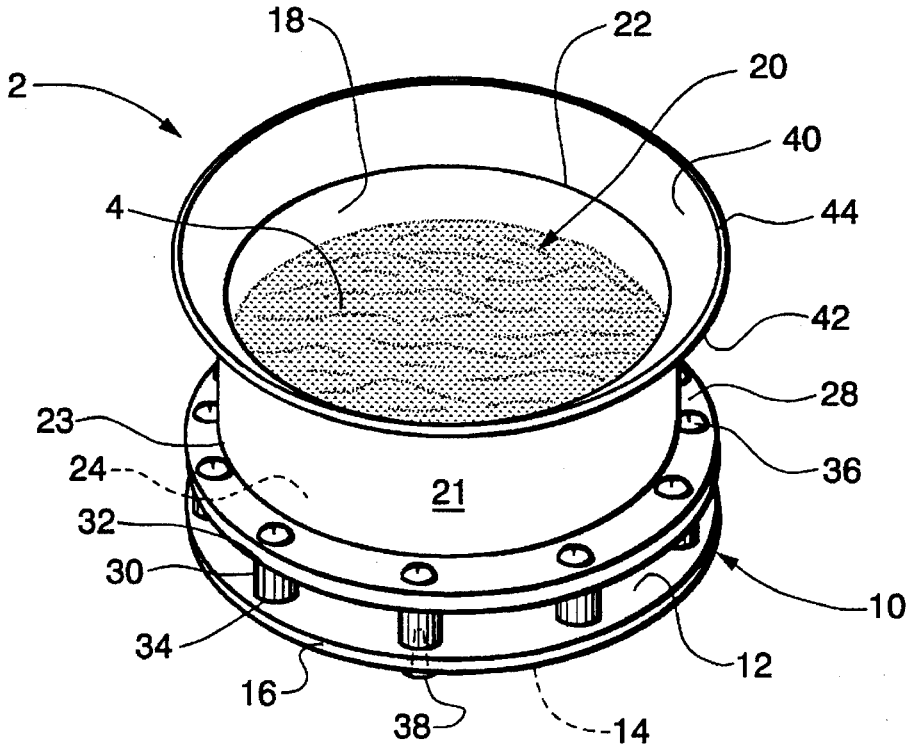
FIG. 2 is a schematic perspective of a second embodiment of the jogging apparatus of the present invention.

Referring now to FIGS. 2 and 3, the top 22 of the side wall 21 comprises a rim 40. The rim 40 has a proximate end 42 and distal end 44. The proximate end 42 is attached to the top 22 of the side wall 21 while the distal end 44 extends outward from the proximate end 42 in a predetermined direction and distance. In the preferred embodiment, because the proximate end 42 of the rim 40 is attached to the top 23 of the side wall 21, the proximate end 42 has the same circumference as the side wall 21. However, the distal end 44 of the rim 40 extends from the top 22 of the side wall 21 at an angle away from the interior space 18 of the container 20, thus having a circumference greater than that of the side wall 21. More specifically, the distal end 44 of the rim 40 extends at an angle delta from the axis of the side wall 21 in a direction away from the interior space 18 of the container 20. In the preferred embodiment, the angle delta is sixty degrees. However, the angle of the rim 40 is not critical and can be adjusted depending on the needs of the user.

Figure 4:
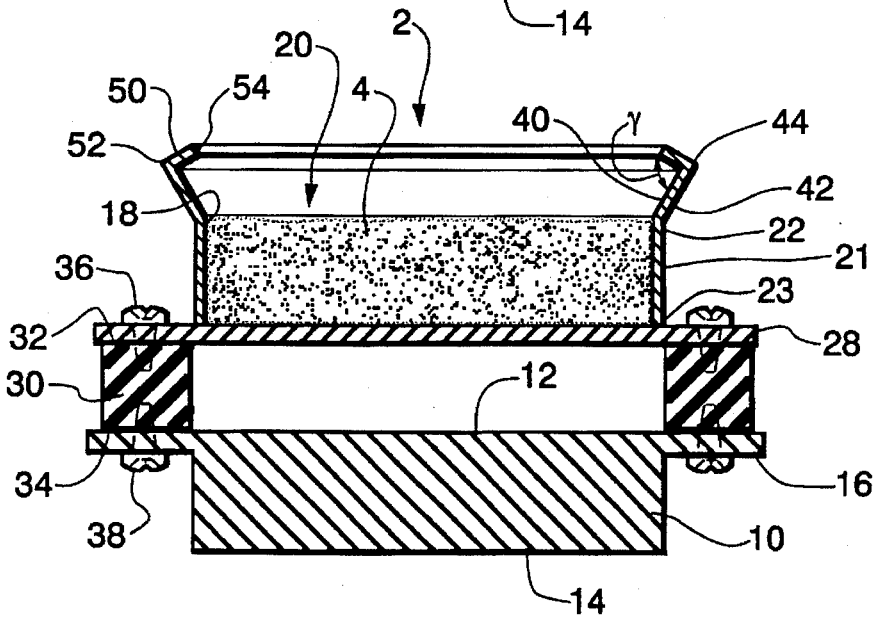
FIG. 4 is a cross-sectional view of another embodiment of the jogging apparatus of the present invention.

Referring now to FIG. 4, there is shown another embodiment of the present jogging apparatus. In this embodiment, the rim 40 is provided with a lip 50. The lip 50 has a proximate end 52 and a distal end 54. The proximate end 52 of the lip 50 is attached to the distal end 44 of the rim 40. The distal end 54 of the lip 50 extends towards the interior space 18 of the container 20 from the axis of the rim 40 at an angle of gamma. It is preferred that the angle gamma be ninety degrees, although various angles will be suitable depending on the user's needs.

Figure 5:
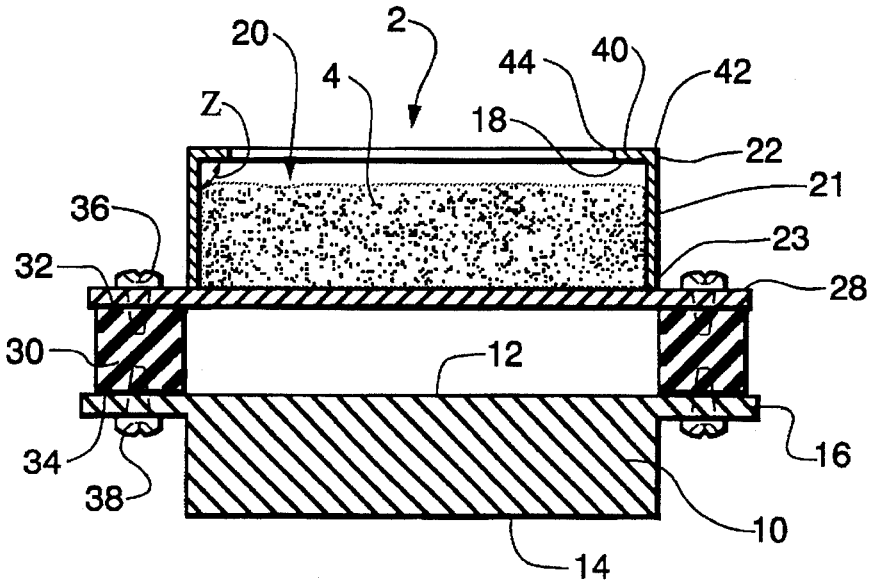
FIG. 5 is a cross-sectional view of an additional embodiment of the jogging apparatus of the present invention.

Referring now to FIG. 5, there is shown yet another embodiment of the present jogging apparatus. In this embodiment, the rim 40 extends toward the interior space 18 of the container 20 at an angle zeta from the axis of the side wall 21. Preferably, the angle zeta is ninety degrees, but can be adjusted depending on the user's needs.

Figure 6:
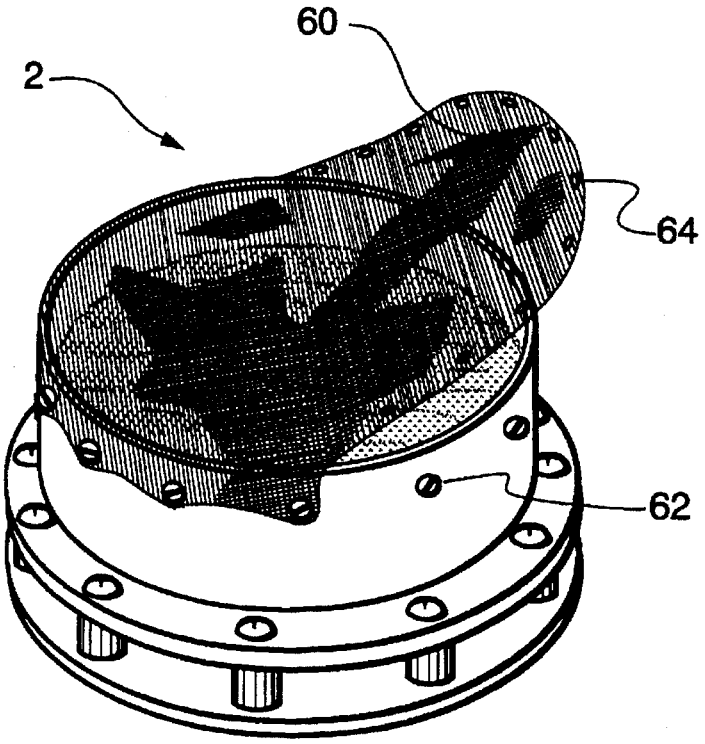
FIG. 6 is a schematic perspective of an embodiment of the jogging apparatus of the present invention including a mesh cover.

Another embodiment of the present jogging apparatus, includes a cover 60 on the container 20 as shown in FIG. 6. The cover 60 is preferably attached through the use of a plurality of first fasteners 62, located along the top 22 of the side wall 21, which work together with a plurality of complimentary second fasteners 64 located around the perimeter 66 of the covering 60. In the preferred embodiment, cover 60 is made from 100 micron nylon mesh which has the capability of containing most of the sand 4 within the interior space 18 of the container 20. However, cover 60 is not limited to a mesh and may be comprised of any other suitable material such as, for example, canvas, vinyl, etc.

Figure 7:
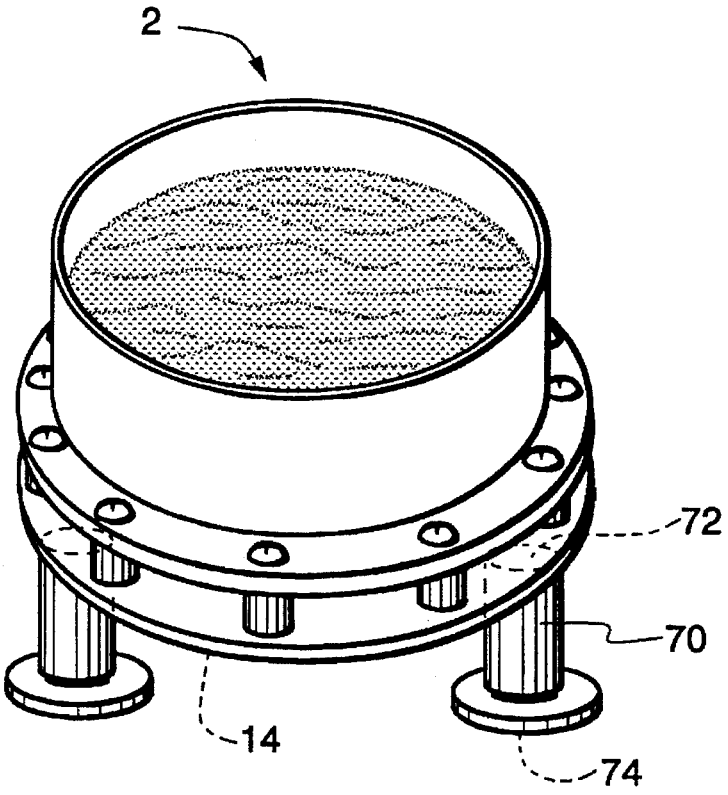
FIG. 7 is a schematic perspective of an embodiment of the jogging apparatus of the present invention including leveling legs.

Referring now to FIG. 7, there is shown another embodiment of the present apparatus. In this embodiment, the base 10 is provided with at least three leveling legs 70. Each of the leveling legs 70 has a top 72 and a bottom 74. The top 72 of each leveling leg 71 is attached to the bottom 14 of the base 10, whereas the bottom 74 of each leg 70 rests on the ground surface. In the preferred embodiment, each of the leveling legs 70 comprises a threaded portion which cooperates with a threaded portion in the base. Thus, the legs 70 may be rotated, and in so doing, are screwed into or out of the base 10 providing adjustability and allowing the user to set the apparatus 2 on an uneven surface in a stable fashion. Other means for providing adjustability are acceptable.

In the same light as the embodiment just described, it is also acceptable for the base 10 to consist solely of the leveling legs 70. In this case, the bottom 34 of each of the shock absorbers 30 is attached to the top 72 of each of the leveling legs 70 respectively, and the legs 70 are screwed into a threaded portion on the shock absorber 30. Accordingly, the number of shock absorbers 30 is limited to the number of leveling legs 70.

In use, the jogging apparatus 2 can be placed on any indoor or outdoor, flat or uneven surface. Particularly, if the user cannot find a flat surface on which to place the jogging apparatus 2, the adjustable leveling legs 70 can be adjusted such that the apparatus 2 will sit stably on an uneven terrain. The inside 18 of the container 20 is filled with sand 4 to a predetermined depth, preferably two to five inches. The user then merely steps into the container 20, onto the sand 4, and begins to jog in place. The sand 4 provides for a naturally yielding surface and the shock absorbers 30 cushion the up and down movement which occurs during the jogging process by absorbing the force of the user's body.

The rim 40 provides a means for containing the sand 4 within the inside 18 of the container 20 while the user is jogging. The mesh covering 60 is used as a means for preventing dirt and other foreign particles from entering the interior space 18 of the container 20 and contaminating the sand 4 while not in use.

Finally, if the user cannot find a flat surface on which to place the jogging apparatus 2, the adjustable leveling legs 70 can be adjusted such that the apparatus 2 will sit stably on an uneven surface.

Those skilled in the art having the benefit of the teachings of the present invention as hereinabove set forth, can effect numerous modifications thereto. These modifications are to be construed as being encompassed within the scope of the present invention as set forth in the appended claims.

I claim:

1. A jogging apparatus comprising:

a base; and a hollow container having an open top defined by a rim, at least one side wall terminating at the rim, an interior space and a bottom, the interior space filled with a predetermined amount of sand wherein the container includes a first perimeter flange, the base includes a second perimeter flange and a plurality of shock absorbers sandwiched between the first and the second perimeter flanges.

2. The apparatus of claim 1 wherein said container is generally circular and has a diameter within the range of twenty four inches to thirty six inches.

3. The apparatus of claim 2 wherein said side wall extends a distance of approximately three to six inches from the bottom of the container to the rim.

4. The apparatus of claim 3 wherein the sand is filled within the enclosure to a depth ranging from two to five inches.

5. The apparatus of claim 3 wherein the rim extends from the side wall away from the interior space at a predetermined angle from the side wall, the rim having a length ranging from one to three inches.

6. The apparatus of claim 5 wherein the rim includes a lip extending towards the interior space from the rim at a predetermined angle, the lip having a length ranging from one to two inches.

7. The apparatus of claim 2 wherein the rim extends from the side wall towards the interior space at a predetermined angle, said rim having a length ranging from one to two inches.

8. The apparatus of claim 5 wherein said sand is filled within the enclosure to a depth ranging from two to five inches.

9. The apparatus of claim 7 wherein said sand is filled within the enclosure to a depth ranging from two to five inches.

10. The apparatus of claim 1 wherein each of the plurality of shock absorbers comprises a rubber stud bumper, each of said bumpers being cylindrical in shape.

11. The apparatus of claim 1 further comprising a cover removably attached to the rim of the container and adapted to cover the entire opening of the container.

12. The apparatus of claim 1 wherein the base comprises a plurality of adjustable leveling legs.

13. The apparatus of claim 12 wherein the plurality of adjustable leveling legs are fixedly attached to the bottom side of the base.

* * * * *